US007641527B1

(12) United States Patent
Balaji et al.

(10) Patent No.: US 7,641,527 B1
(45) Date of Patent: Jan. 5, 2010

(54) MARINE OUTBOARD ENGINE EXHAUST SYSTEM

(75) Inventors: Ben Balaji, Gurnee, IL (US); Richard McChesney, Waukegan, IL (US); Rudolf Wendler, Grayslake, IL (US)

(73) Assignee: BRP US Inc., Sturtevant, WI (US)

( * ) Notice: Subject to any disclaimer, the term of this patent is extended or adjusted under 35 U.S.C. 154(b) by 62 days.

(21) Appl. No.: 11/948,651

(22) Filed: Nov. 30, 2007

(51) Int. Cl.

| | |
|---|---|
| ***B63H 21/00*** | (2006.01) |
| *B63H 21/10* | (2006.01) |
| *B63H 21/38* | (2006.01) |
| *F01N 3/20* | (2006.01) |
| *F01N 7/12* | (2006.01) |
| *B63H 21/32* | (2006.01) |
| *F01N 1/08* | (2006.01) |

(52) U.S. Cl. ..... 440/89 R; 440/88 R; 440/89 C; 440/89 D; 440/89 J

(58) Field of Classification Search ..... 440/88 R, 440/89 R, 89 C, 89 D, 89 J; 60/302, 310
See application file for complete search history.

(56) References Cited

U.S. PATENT DOCUMENTS

| | | | | |
|---|---|---|---|---|
| 4,337,054 | A | 6/1982 | Holtermann et al. | |
| 4,607,723 | A | 8/1986 | Okazaki | |
| 4,795,383 | A | 1/1989 | Binversie et al. | |
| 4,897,060 | A | 1/1990 | Okazaki | |
| 4,960,398 | A | 10/1990 | Potratz | |
| 4,965,997 | A * | 10/1990 | Suzuki et al. | 60/310 |
| 5,174,112 | A | 12/1992 | Sougawa et al. | |
| 5,280,708 | A * | 1/1994 | Sougawa et al. | 60/302 |
| 5,299,961 | A | 4/1994 | Okamoto | |
| 5,370,564 | A | 12/1994 | Fujimoto et al. | |
| 5,674,099 | A | 10/1997 | Muramatsu et al. | |
| 6,350,166 | B1 | 2/2002 | Herrera | |
| 2007/0028597 | A1 | 2/2007 | Radue et al. | |

FOREIGN PATENT DOCUMENTS

| | | |
|---|---|---|
| JP | 5519082 | 2/1980 |

OTHER PUBLICATIONS

English Translation of Japanese Patent No. JP5519082, 1980.

* cited by examiner

*Primary Examiner*—Lars A Olson
*Assistant Examiner*—Daniel V Venne
(74) *Attorney, Agent, or Firm*—Olser, Hoskin & Harcourt LLP

(57) ABSTRACT

A marine outboard engine has an upper motor cover, a lower cover, an engine, a driveshaft, a gear case, a rotor shaft, and a bladed rotor. First and second exhaust housings are disposed in the lower cover below the engine. The second exhaust housing at least partially surrounds the first exhaust housing. A first exhaust chamber is formed by the first exhaust housing. The first exhaust chamber fluidly communicates with the engine. A second exhaust chamber is formed between the second exhaust housing and the first exhaust housing. The second exhaust chamber fluidly communicates with the first exhaust chamber. A third exhaust chamber formed between the second exhaust housing and the first exhaust housing below the second exhaust chamber is also disclosed. The third exhaust chamber fluidly communicates with the second exhaust chamber and an exterior of the marine outboard engine.

16 Claims, 5 Drawing Sheets

B-B

A-A

MARINE OUTBOARD ENGINE EXHAUST SYSTEM

FIELD OF THE INVENTION

The present invention relates to a marine outboard engine exhaust system.

SUMMARY OF THE INVENTION

It is an object of the present invention to provide a marine outboard engine having an exhaust system that has a first exhaust housing forming a first exhaust chamber, a second exhaust housing, and a second exhaust chamber formed between the second exhaust housing and at least a portion of at least two sides of the first exhaust housing.

It is another object of the present invention to provide a marine outboard engine having an exhaust system that has three exhaust chambers.

It is yet another object of the present invention to provide a marine outboard engine having a first exhaust housing forming a first exhaust chamber, and also having additional exhaust chambers fluidly communicating with the first exhaust chamber.

In one aspect, the invention provides a marine outboard engine having an upper motor cover, a lower cover disposed vertically below the upper motor cover, an engine disposed at least in part in the upper motor cover, and a driveshaft disposed generally vertically in the lower cover. The driveshaft has a first end and a second end. The first end of the driveshaft is operatively connected to the engine. A gear case is connected to the lower cover. A rotor shaft is disposed at least in part in the gear case generally perpendicular to the driveshaft. The rotor shaft is operatively connected to the second end of the driveshaft. A bladed rotor is connected to the rotor shaft. A first exhaust housing is disposed in the lower cover below the engine. The first exhaust housing has a left side, a right side, a front side, and a rear side. A second exhaust housing is disposed in the lower cover below the engine. The second exhaust housing at least partially surrounds the first exhaust housing. A first exhaust chamber is formed by the first exhaust housing. The first exhaust chamber fluidly communicates with the engine. A second exhaust chamber is formed between the second exhaust housing and at least a portion of at least two of the left, right, front, and rear sides of the first exhaust housing. The second exhaust chamber fluidly communicates with the first exhaust chamber and an exterior of the marine outboard engine. Exhaust gases from the engine flow to the first exhaust chamber, from the first exhaust chamber to the second exhaust chamber, and from the second exhaust chamber to the exterior of the marine outboard engine.

In an additional aspect, the second exhaust chamber is formed between the second exhaust housing and at least a portion of at least three of the left, right, front, and rear sides of the first exhaust housing.

In a further aspect, the second exhaust chamber is formed between the second exhaust housing and the left, right, and rear sides of the first exhaust housing.

In an additional aspect, the marine outboard engine also has a third exhaust chamber formed between the second exhaust housing and at least a portion of at least two of the left, right, front, and rear sides of the first exhaust housing below the second exhaust chamber. The third exhaust chamber fluidly communicates with the second exhaust chamber and an exterior of the marine outboard engine. Exhaust gases from the engine flow to the first exhaust chamber, from the first exhaust chamber to the second exhaust chamber, and from the second exhaust chamber to the third exhaust chamber, and from the third exhaust chamber to the exterior of the marine outboard engine.

In a further aspect, the second and third exhaust chambers are formed between the second exhaust housing and at least a portion of at least three of the left, right, front, and rear sides of the first exhaust housing.

In an additional aspect, the second and third exhaust chambers are formed between the second exhaust housing and the left, right, and rear sides of the first exhaust housing.

In a further aspect, the marine outboard engine also has at least one first conduit fluidly communicating the first exhaust chamber with the second exhaust chamber, at least one second conduit fluidly communicating the second exhaust chamber with the third exhaust chamber; and at least one third conduit fluidly communicating the third exhaust chamber with the exterior of the marine outboard engine.

In an additional aspect, an outlet of the at least one third conduit fluidly communicating with the exterior of the marine outboard engine is located vertically higher than the bladed rotor.

In a further aspect, the marine outboard engine also has at least one first conduit fluidly communicating the first exhaust chamber with the second exhaust chamber, and at least one second conduit fluidly communicating the second exhaust chamber with the exterior of the marine outboard engine.

In another aspect, the invention provides a marine outboard engine having an upper motor cover, a lower cover disposed vertically below the upper motor cover, an engine disposed at least in part in the upper motor cover, a driveshaft disposed generally vertically in the lower cover. The driveshaft has a first end and a second end. The first end of the driveshaft is operatively connected to the engine. A gear case is connected to the lower cover. A rotor shaft is disposed at least in part in the gear case generally perpendicular to the driveshaft. The rotor shaft is operatively connected to the second end of the driveshaft. A bladed rotor is connected to the rotor shaft. A first exhaust housing is disposed in the lower cover below the engine. A second exhaust housing is disposed in the lower cover below the engine. The second exhaust housing at least partially surrounds the first exhaust housing. A first exhaust chamber is formed by the first exhaust housing. The first exhaust chamber fluidly communicates with the engine. A second exhaust chamber is formed between the second exhaust housing and the first exhaust housing. The second exhaust chamber fluidly communicates with the first exhaust chamber. A third exhaust chamber is formed between the second exhaust housing and the first exhaust housing below the second exhaust chamber. The third exhaust chamber fluidly communicates with the second exhaust chamber and an exterior of the marine outboard engine. A combined volume of the second and third exhaust chambers is greater than a volume of the first exhaust chamber. Exhaust gases from the engine flow to the first exhaust chamber, from the first exhaust chamber to the second exhaust chamber, from the second exhaust chamber to the third exhaust chamber, and from the third exhaust chamber to the exterior of the marine outboard engine.

In an additional aspect, the marine outboard engine also has at least one first conduit fluidly communicating the first exhaust chamber with the second exhaust chamber, at least one second conduit fluidly communicating the second exhaust chamber with the third exhaust chamber, and at least one third conduit fluidly communicating the third exhaust chamber with the exterior of the marine outboard engine.

In a further aspect, an outlet of the at least one third conduit fluidly communicating with the exterior of the marine outboard engine is located vertically higher than the bladed rotor.

In an additional aspect, the marine outboard engine also has a first generally horizontal wall separating the second exhaust chamber from the third exhaust chamber, and a second generally horizontal wall disposed at a bottom of the third exhaust chamber. The at least one first exhaust conduit passes through an aperture in a generally vertical side of the first exhaust housing. The at least one second exhaust conduit passes through an aperture in the first generally horizontal wall. The at least one third exhaust conduit passes through an aperture in the second generally horizontal wall and an aperture in the lower cover.

In a further aspect, the first exhaust housing includes an upper end, a lower end, a first side wall extending generally vertically from the lower end to the upper end, a second side wall, opposite the first side wall, extending generally vertically from the lower end to the upper end, a first aperture in the first side wall near the upper end, and a second aperture in the second side wall near the upper end. The marine outboard engine also has a conduit having a first end, a second end opposite the first end, a conduit body disposed between the first and second ends, and a plurality of apertures in the conduit body. The first end of the conduit is connected to the first aperture. The second end of the conduit is connected to the second aperture. The conduit body extends in the second exhaust chamber. Exhaust gases from the first exhaust chamber flow in the first and second ends of the conduit, flow through the conduit body, and flow from the conduit body to the second exhaust chamber via the plurality of apertures in the conduit body.

In an additional aspect, the first exhaust housing includes an upper end, a lower end, a wall disposed generally vertically inside the first exhaust housing, the wall dividing the first exhaust chamber so as to form a first sub-chamber and a second sub-chamber, a first aperture between the upper and lower ends of the first exhaust housing, the first aperture fluidly communicating the first sub-chamber with the second sub-chamber, and a second aperture near the upper end of the first exhaust housing, the second aperture fluidly communicating the second sub-chamber with the second exhaust chamber. Exhaust gases from the engine flow to the first sub-chamber, flow downwardly in the first sub-chamber to the first aperture, flow through the first aperture to the second sub-chamber, flow upwardly in the second sub-chamber, and flow through the second aperture to the second exhaust chamber.

In a further aspect, the wall disposed inside the first exhaust housing extends laterally inside the first exhaust housing.

In an additional aspect, the first sub-chamber is disposed rearwardly of the second sub-chamber.

For purposes of this application, description of the spatial orientation of the various elements described herein is being made relative to a position of the marine outboard engine where the driveshaft is in a vertical orientation. It should be understood that should the orientation of the marine outboard engine change, such as when the marine outboard engine is trimmed or tilted, the description of the spatial orientation of the various elements should still be understood with respect to the orientation of the driveshaft representing the vertical orientation. Also for purposes of this application, the terms "exterior of the marine outboard engine" refer to the environment in which the marine outboard engine operates, and therefore the exterior of the marine outboard engine includes both air and water.

Embodiments of the present invention each have at least one of the above-mentioned objects and/or aspects, but do not necessarily have all of them. It should be understood that some aspects of the present invention that have resulted from attempting to attain the above-mentioned objects may not satisfy these objects and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION OF THE PREFERRED EMBODIMENTS

Figure 1:
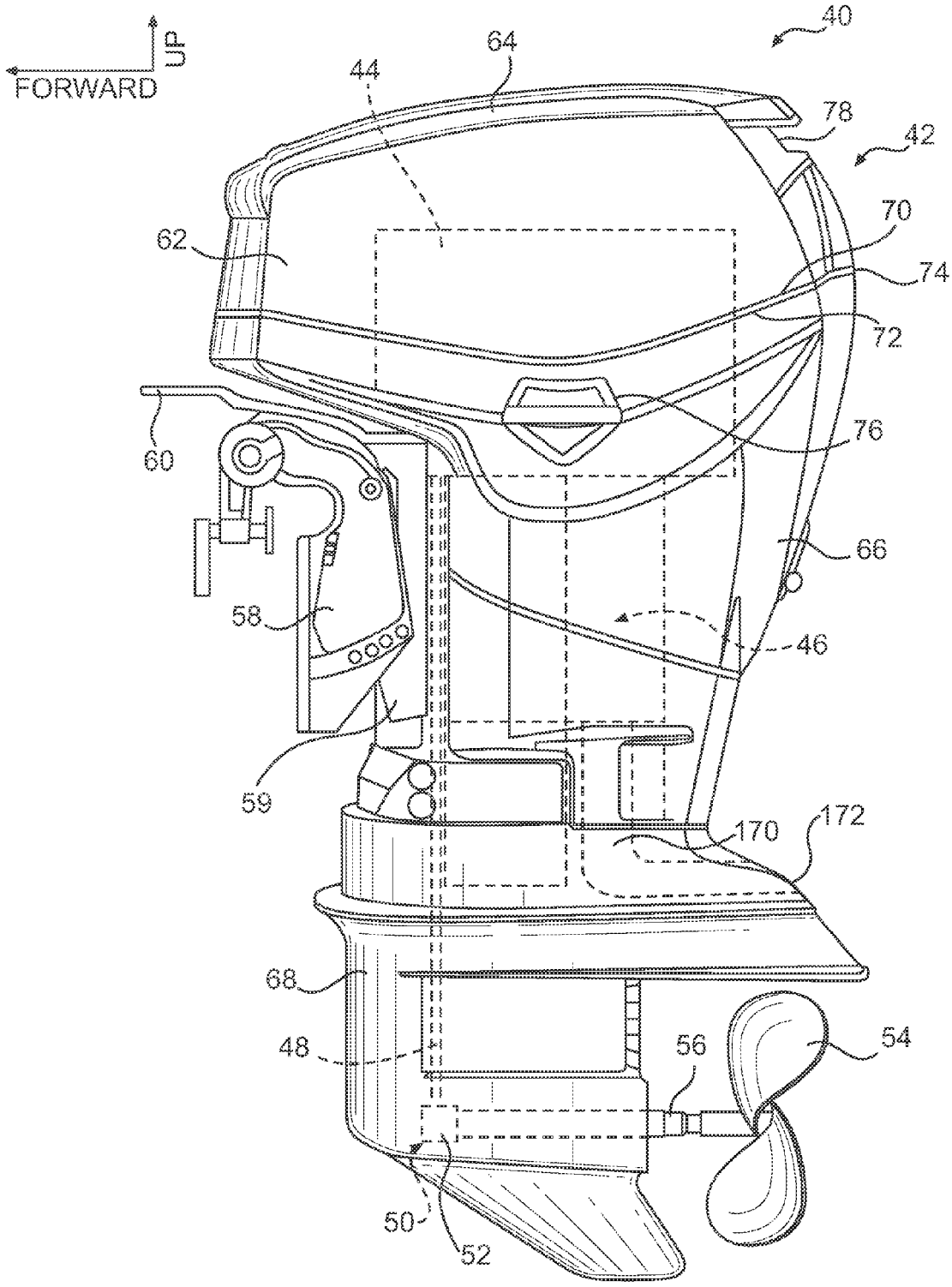
FIG. 1 is a side elevation view of a marine outboard engine according to the present invention.

Referring to the figures, FIG. 1 is a side view of a marine outboard engine 40 having a cowling 42. The cowling 42 surrounds and protects an engine 44, shown schematically. Engine 44 is a V6, two-stroke, internal combustion engine. It is contemplated that other types of engines could be used, such as a four-stroke engine, or an engine having an in-line cylinder arrangement.

The engine 44 is coupled to a vertically oriented driveshaft 48. The driveshaft 48 is coupled to a drive mechanism 50, which includes a transmission 52 and a bladed rotor, such as a propeller 54, mounted on a rotor shaft 56. The rotor shaft 56 is generally perpendicular to the driveshaft 48. The drive mechanism 50 could also include a jet propulsion device, turbine or other known propelling device. The bladed rotor could also be an impeller. Other known components of an engine assembly are included within the cowling 42, such as a starter motor and an alternator. As it is believed that these components would be readily recognized by one of ordinary skill in the art, further explanation and description of these components will not be provided herein.

A stern bracket 58 is connected to the cowling 42 via a swivel bracket 59 for mounting the outboard engine 40 to a watercraft. The stern bracket 58 can take various forms, the details of which are conventionally known. The swivel bracket 59 houses a steering shaft (not shown) of the outboard engine 40. A steering mechanism, such as the steering wheel of a boat associated with a hydraulic actuator, is connected to a linkage 60 extending from the swivel bracket 59 to permit steering of the outboard engine 40.

The cowling 42 includes several primary components, including an upper motor cover 62 with a top cap 64, and a lower cover 66 disposed vertically below the upper motor cover 62. The upper motor cover 62 preferably encloses the top portion of the engine 44. The lower cover 66 surrounds the remainder of the engine 44. An exhaust system 46 of the engine 44 and the driveshaft 48 are disposed at least in part in the lower cover 66. The gear case 68 encloses the transmission 52 and supports the drive mechanism 50, in a known manner. A gear case is connected to the lower cover 66. The rotor shaft 56 is disposed in part in, and extends from, the gear case 68 and supports the propeller 54.

The upper motor cover 62 and the lower cover 66 are made of sheet material, preferably plastic, but could also be metal, composite or the like. The lower cover 66 and/or other components of the cowling 42 can be formed as a single piece or as several pieces. For example, the lower cover 66 can be formed as two lateral pieces that mate along a vertical joint. The lower cover 66, which is also made of sheet material, is preferably made of composite, but could also be plastic or metal. One suitable composite is fiberglass.

A lower edge 70 of the upper motor cover 62 mates in a sealing relationship with an upper edge 72 of the lower cover 66. A seal 74 is disposed between the lower edge 70 of the upper motor cover 62 and the upper edge 72 of the lower cover 66 to form a watertight connection.

A locking mechanism 76 is provided on at least one of the sides of the cowling 42. Preferably, locking mechanisms 76 are provided on each side of the cowling 10.

The upper motor cover 62 is formed with two parts, but could also be a single cover. As seen in FIG. 1, the upper motor cover 62 includes an air intake portion 78 formed as a recessed portion on the rear of the cowling 42. The air intake portion 78 is configured to prevent water from entering the interior of the cowling 42 and reaching the engine 44. Such a configuration can include a tortuous path. The top cap 64 fits over the upper motor cover 62 in a sealing relationship and preferably defines a portion of the air intake portion 78. Alternatively, the air intake portion 78 can be wholly formed in the upper motor cover 62 or even the lower motor cover 66.

Turning now to FIGS. 2 to 11, the exhaust system 46 will be described in more detail. The exhaust system 46 includes a first exhaust housing 100 and a second exhaust housing 102. Both exhaust housings 100, 102 are disposed in the lower cover 66 below the engine 44 (see FIG. 1).

Figure 5:
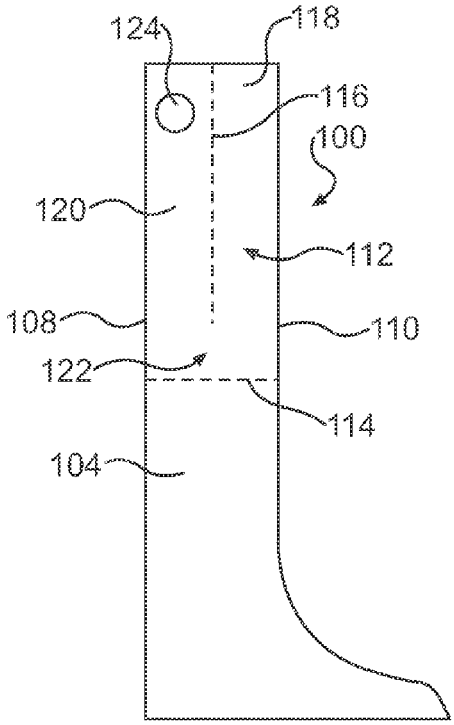
FIG. 5 is a schematic left side elevation view of a first exhaust housing of the exhaust system of FIG. 2.
Figure 6:
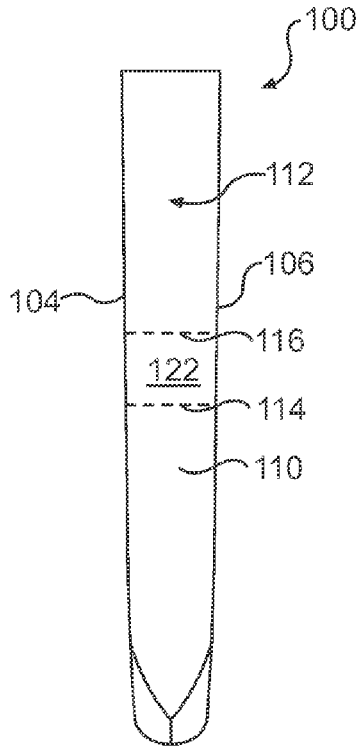
FIG. 6 is a schematic rear elevation view of the first exhaust housing of FIG. 5.
Figure 7:
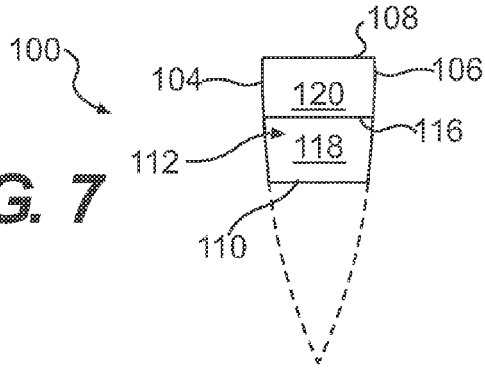
FIG. 7 is a schematic top view of the first exhaust housing of FIG. 5.

As best seen in FIGS. 5 to 7, the first exhaust housing 100 has a left side 104, a right side 106, a front side 108, and a rear side 110. The first exhaust housing 100 forms a first exhaust chamber 112 therein. A generally horizontal wall 114 (shown in phantom) disposed in the first exhaust housing 100 between the ends of the first exhaust housing 100, forms a bottom portion of the first exhaust chamber 112. Another wall 116 (shown in phantom) extends laterally between the left side 104 and the right side 106, and extends downwardly from the upper end of the first exhaust housing 100 so as to divide the first exhaust chamber 112 into a first exhaust sub-chamber 118 and a second exhaust sub-chamber 120. As can be seen, the first exhaust sub-chamber 118 is disposed rearwardly of the second exhaust sub-chamber 120. The wall 116 does not extend all the way down to the wall 114 so as to form an aperture 122 at the bottom of the first exhaust chamber 112 that permits fluid communication between the first and second exhaust sub-chambers 118, 120. The upper end of the first exhaust sub-chamber 118 is connected to an exhaust manifold (not shown) of the engine 44. An aperture 124 is formed near the upper end of the second exhaust sub-chamber 120 in each of the left and right sides 104, 106, to fluidly communicate the second exhaust sub-chamber 120 with a remainder of the exhaust system 46 as described in greater detail below. It is contemplated that the wall 116 could extend longitudinally between the front side 108 and the rear side 110 such that the first and second exhaust sub-chambers 118, 120 are disposed side by side, with apertures 124 disposed accordingly so as to communicate the second exhaust sub-chamber 120 with the second exhaust chamber 156. It is also contemplated that the first exhaust sub-chamber 118 could be disposed forwardly of the second sub-chamber 120. It is also contemplated that the wall 116 could be omitted.

Figure 3:
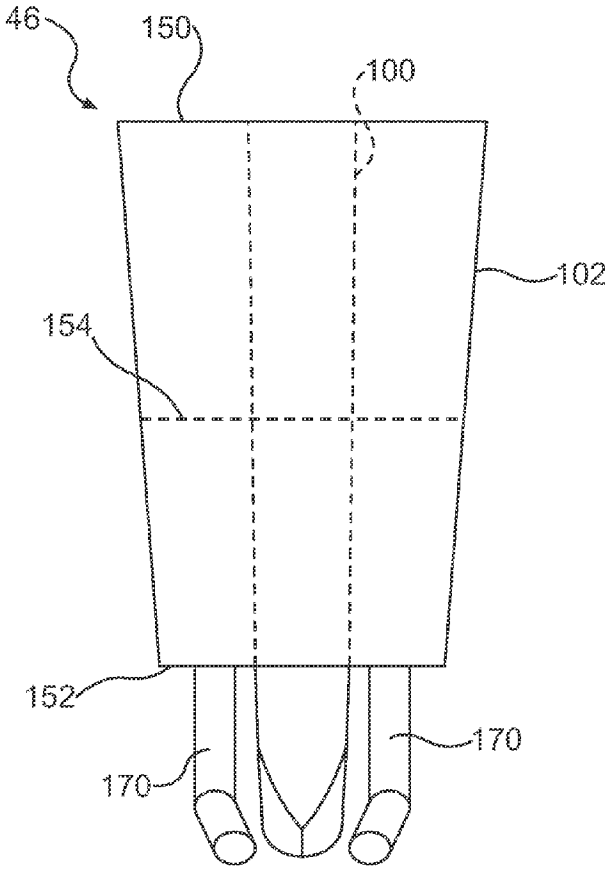
FIG. 3 is a schematic rear elevation view of the exhaust system of FIG. 2.
Figure 2:
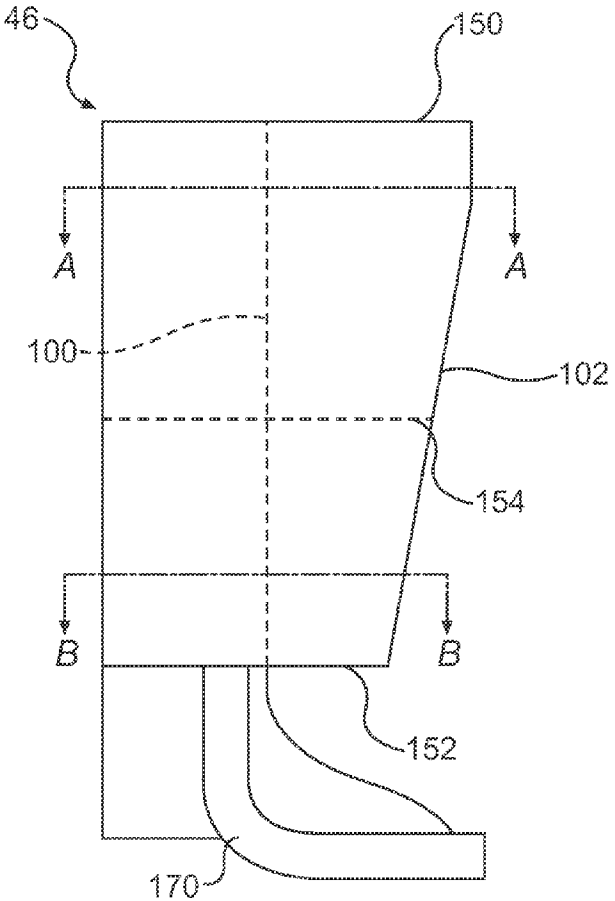
FIG. 2 is a schematic left side elevation view of the exhaust system of the marine outboard engine of FIG. 1.
Figure 4:
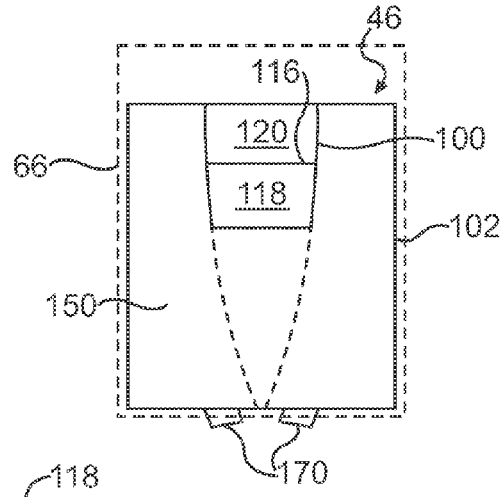
FIG. 4 is a schematic top view of the exhaust system of FIG. 2.
Figure 11:
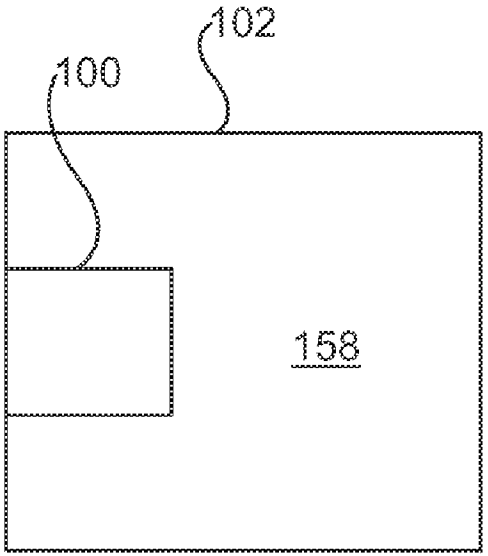
FIG. 11 is a cross-sectional view of the exhaust system taken through line B-B of FIG. 2.

Turning now to FIGS. 2 to 4, it can be seen that the second exhaust housing 102 surrounds the first exhaust housing 100. The second exhaust housing 102 occupies a majority of the space in the lower cover 66 (shown in phantom in FIG. 4). It is contemplated that the second exhaust housing 102 and the lower cover 66 could be integrally formed as a single part. Generally horizontal top and bottom walls 150, 152 are located at the upper and lower ends of the second exhaust housing 102 respectively. A generally horizontal central wall 154 is located inside the second exhaust housing 102 between the top and bottom walls 150, 152. As seen in FIGS. 8 to 11, a second exhaust chamber 156 is formed between the top wall 150, the central wall 154, the second exhaust housing 102, and the left side 104, right side 106, and rear side 110 of the first exhaust housing 100. As such, the second exhaust chamber 156 has a generally U-shaped horizontal cross-section as best seen in FIG. 10. A third exhaust chamber 158 is formed between the central wall 154, the bottom wall 152, the second exhaust housing 102, and the left side 104, right side 106, and rear side 110 of the first exhaust housing 100. As such, the third exhaust chamber 158 has a generally U-shaped horizontal cross-section as best seen in FIG. 11. The second exhaust chamber 156 fluidly communicates with the second exhaust sub-chamber 120 of the first exhaust chamber 112 as described in greater detail below. The third exhaust chamber 158 fluidly communicates with the second exhaust chamber 156 and with an exterior of the marine outboard engine 40 as described in greater detail below. It is contemplated that the second exhaust housing 102 could only partially surround the first exhaust housing 100, such that each of the second and third exhaust chambers 156, 158 would be formed between the second exhaust housing 102 and at least a portion of only two of the sides of the first exhaust housing 100. It is also contemplated that the second and third exhaust chambers 156, 158 could each be formed between the second exhaust housing 102 and at least a portion of three other sides of the first exhaust housing 100, such as the left side 104, right side 106, and the front side 108 for example. It is also contemplated that the second exhaust housing 102 could be disposed relative to the first exhaust housing 100 such that the second and third exhaust chambers 156, 158 could each be formed between the second exhaust housing 102 and all four sides 104, 106, 108, and 110 of the first exhaust housing 100. In some embodiments, it is contemplated that the central wall 154 could be omitted such that the exhaust system 46 does not have a third exhaust chamber 158 and the second exhaust chamber 156 would fluidly communicate with the exterior of the marine outboard engine 40.

The volumes of the first, second, and third exhaust chambers 112, 156, 158 are determined based on the engine type and power so as to provide desired performance and acoustic characteristics. Generally, the volumes used for a 4-cylinder, two-stroke engine will be smaller than those used for a 6-cylinder, two stroke engine (for identical displacement). Preferably, the combined volume of the second and third exhaust chambers 156, 158 is greater than a volume of the first exhaust chamber 112. It is contemplated that a catalytic converter could be disposed in any one of the first, second, and third exhaust chambers 112, 156, 158 to provide for post-combustion exhaust treatment.

Figure 9:
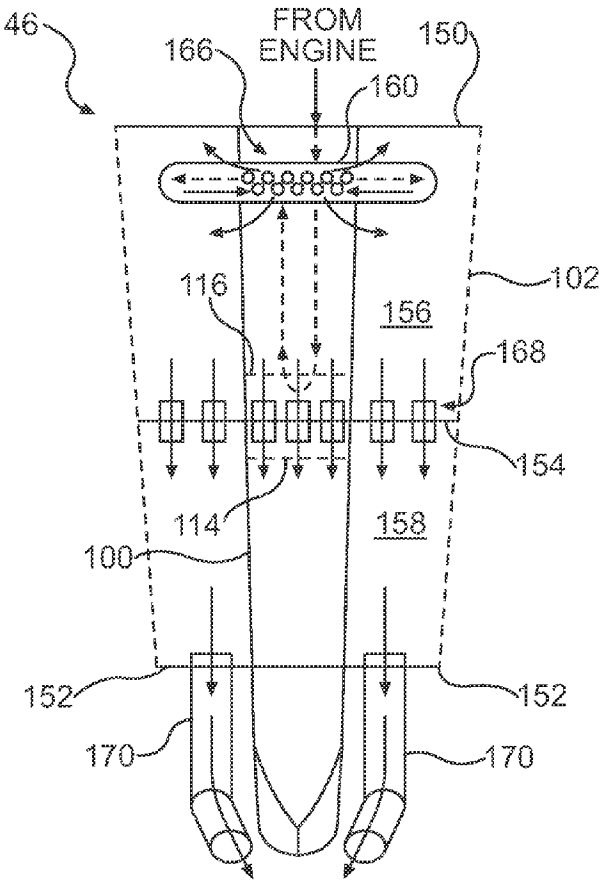
FIG. 9 is a schematic rear elevation view of FIG. 8.
Figure 8:
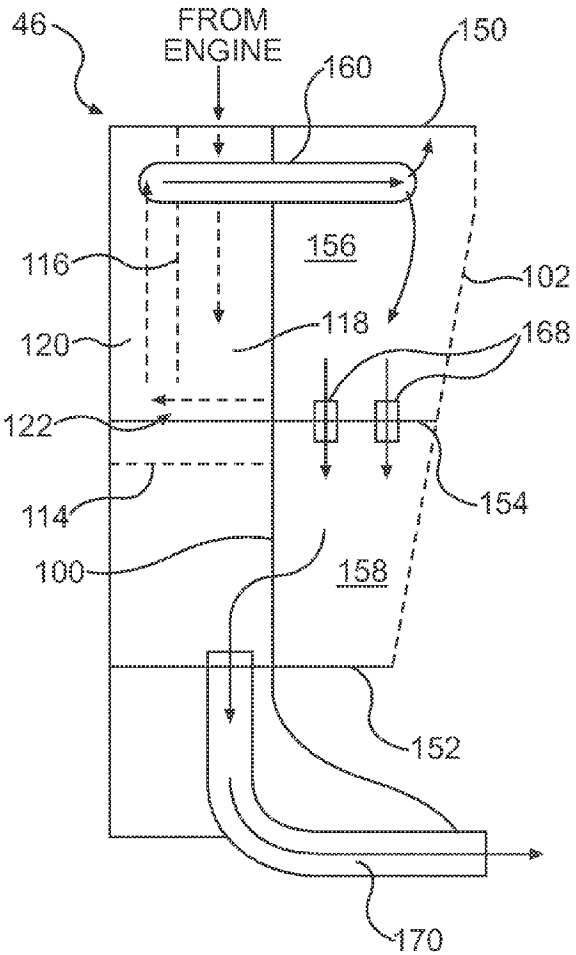
FIG. 8 is a schematic left side elevation view of the exhaust system of the marine outboard engine of FIG. 1, with the second exhaust housing in phantom to show some of the internal components of the exhaust system.
Figure 10:
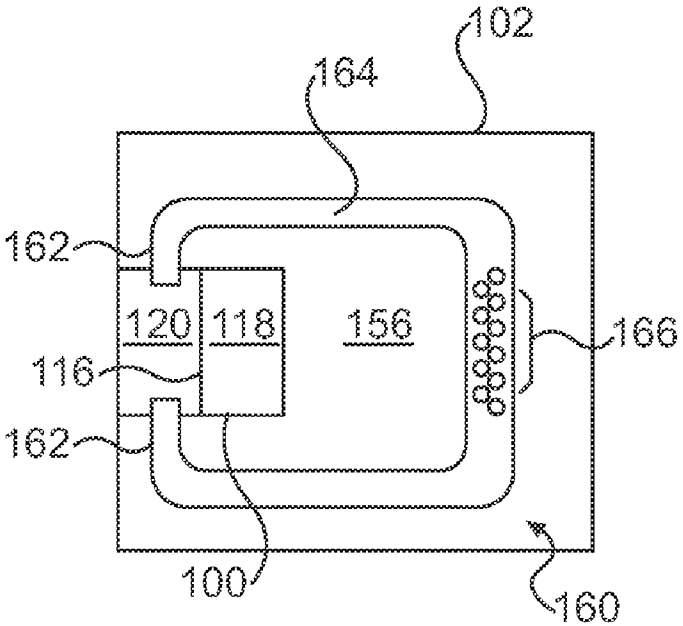
FIG. 10 is a cross-sectional view of the exhaust system taken through line A-A of FIG. 2.

Turning now to FIGS. 8 to 10, the various exhaust conduits used to fluidly communicate the exhaust chambers 112, 156, 158, and the exterior of the outboard engine 40 together will be described. A first exhaust conduit 160 extending generally horizontally in the second exhaust chamber 156 fluidly communicates the first exhaust chamber 112 with the second exhaust chamber 156. As best seen in FIG. 10, the first exhaust conduit 160 has two ends 162 which pass through the apertures 124 in the second exhaust sub-chamber 120 and has a generally U-shaped conduit body 164 between the ends 162. The conduit body 164 has a plurality of apertures 166. The diameter and number of apertures 166 is determined based on the engine type and power so as to provide desired performance and acoustic characteristics. A plurality of exhaust conduits, consisting of straight pipes 168, fluidly communicate the second exhaust chamber 156 with the third exhaust chamber 158. The pipes 168 pass through a corresponding number of apertures in the central wall 154. The diameter, length, and number of pipes 168 is determined based on the engine type and power so as to provide desired performance and acoustic characteristics. Two more exhaust conduits, in the form of exhaust pipes 170 fluidly communicate the third exhaust chamber 158 with the exterior of the marine outboard engine 40. A first end of each exhaust pipe 170 passes through a corresponding aperture in the bottom wall 152. A second end of each exhaust pipe 170 passes through a corresponding aperture 172 in the lower cover 66 located vertically higher than the propeller 54, as seen in FIG. 1. At low speeds, the apertures 172 are disposed below the water. At high speeds, when a watercraft associated with the marine outboard engine 40 is on plane, the apertures 172 are disposed above the water and exhaust gases go directly to the atmosphere. The above-described arrangement of exhaust conduits is only one possible embodiment. Other arrangements are contemplated. For example, it is contemplated that the first exhaust chamber 112 could have only one aperture 124 with conduit 160 being replaced with a single straight pipe, and that only one pipe 168 and only one exhaust pipe 170 could be used. It is also contemplated that more than two apertures 124, conduits 160, and exhaust pipes 170 could be used. As would be understood, the lengths, diameters, and number of the exhaust conduits will depend on the engine type and power so as to obtain the desired performance and acoustic characteristics. It is contemplated that the various conduits could be integrally, or at least partially, formed with the components to which they connect. For example, exhaust pipes 170 could be integrally cast with the bottom wall 152.

Turning now to FIGS. 8 and 9, the flow of exhaust gases from the engine 44 to the exterior of the outboard engine 40, as indicated by the directional arrows in these Figures, will be described. Exhaust gases from the engine 44 flow to an exhaust manifold (not shown). From the exhaust manifold, the exhaust gases flow to the first exhaust chamber 112 via the upper end of the first exhaust sub-chamber 118 and flow downwardly in the first exhaust sub-chamber 118 to the aperture 122. The gases then flow through the aperture 122 to the second exhaust sub-chamber 120 and flow upwardly in the second exhaust sub-chamber 120. From there, the gases flow in the ends 162 of the conduit 160, flow through the conduit body 164, and flow from the conduit body 164 to the second exhaust chamber 156 via the plurality of apertures 166 in the conduit body 164. Gases in the second exhaust chamber 156 then flow through the pipes 168 to the third exhaust chamber 158. Gases in the third exhaust chamber 158 finally flow through the exhaust pipes 170 to the exterior of the marine outboard engine 40.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A marine outboard engine comprising:

an upper motor cover;

a lower cover disposed vertically below the upper motor cover;

an engine disposed at least in part in the upper motor cover;

a driveshaft disposed generally vertically in the lower cover, the driveshaft having a first end and a second end, the first end of the driveshaft being operatively connected to the engine;

a gear case connected to the lower cover;

a rotor shaft disposed at least in part in the gear case generally perpendicular to the driveshaft, the rotor shaft being operatively connected to the second end of the driveshaft;

a bladed rotor connected to the rotor shaft;

a first exhaust housing disposed in the lower cover below the engine, the first exhaust housing having a left side, a right side, a front side, and a rear side;

a second exhaust housing disposed in the lower cover below the engine, the second exhaust housing at least partially surrounding the first exhaust housing;

a first exhaust chamber formed by the first exhaust housing, the first exhaust chamber fluidly communicating with the engine;

a second exhaust chamber formed between the second exhaust housing and at least a portion of at least two of the left, right, front, and rear sides of the first exhaust housing, the second exhaust chamber fluidly communicating with the first exhaust chamber; and a third exhaust chamber formed between the second exhaust housing and at least a portion of at least two of the left, right, front, and rear sides of the first exhaust housing below the second exhaust chamber, the third exhaust chamber fluidly communicating with the second exhaust chamber and an exterior of the marine outboard engine;

wherein exhaust gases from the engine flow to the first exhaust chamber, from the first exhaust chamber to the second exhaust chamber, from the second exhaust chamber to the third exhaust chamber, and from the third exhaust chamber to the exterior of the marine outboard engine.

2. The marine outboard engine of claim 1, wherein the second exhaust chamber is formed between the second exhaust housing and at least a portion of at least three of the left, right, front, and rear sides of the first exhaust housing.

3. The marine outboard engine of claim 2, wherein the second exhaust chamber is formed between the second exhaust housing and the left, right, and rear sides of the first exhaust housing.

4. The marine outboard engine of claim 1, wherein the second and third exhaust chambers are formed between the second exhaust housing and at least a portion of at least three of the left, right, front, and rear sides of the first exhaust housing.

5. The marine outboard engine of claim 4, wherein the second and third exhaust chambers are formed between the second exhaust housing and the left, right, and rear sides of the first exhaust housing.

6. The marine outboard engine of claim 5, further comprising:

at least one first conduit fluidly communicating the first exhaust chamber with the second exhaust chamber;

at least one second conduit fluidly communicating the second exhaust chamber with the third exhaust chamber; and at least one third conduit fluidly communicating the third exhaust chamber with the exterior of the marine outboard engine.

7. The marine outboard engine of claim 6, wherein an outlet of the at least one third conduit fluidly communicating with the exterior of the marine outboard engine is located vertically higher than the bladed rotor.

8. The marine outboard engine of claim 1, further comprising:

at least one first conduit fluidly communicating the first exhaust chamber with the second exhaust chamber;

at least one second conduit fluidly communicating the second exhaust chamber with the exterior of the marine outboard engine.

9. A marine outboard engine comprising:

an upper motor cover;

a lower cover disposed vertically below the upper motor cover;

an engine disposed at least in part in the upper motor cover;

a driveshaft disposed generally vertically in the lower cover, the driveshaft having a first end and a second end, the first end of the driveshaft being operatively connected to the engine;

a gear case connected to the lower cover;

a rotor shaft disposed at least in part in the gear case generally perpendicular to the driveshaft, the rotor shaft being operatively connected to the second end of the driveshaft;

a bladed rotor connected to the rotor shaft;

a first exhaust housing disposed in the lower cover below the engine;

a second exhaust housing disposed in the lower cover below the engine, the second exhaust housing at least partially surrounding the first exhaust housing;

a first exhaust chamber formed by the first exhaust housing, the first exhaust chamber fluidly communicating with the engine;

a second exhaust chamber formed between the second exhaust housing and the first exhaust housing, the second exhaust chamber fluidly communicating with the first exhaust chamber; and a third exhaust chamber formed between the second exhaust housing and the first exhaust housing below the second exhaust chamber, the third exhaust chamber fluidly communicating with the second exhaust chamber and an exterior of the marine outboard engine, a combined volume of the second and third exhaust chambers being greater than a volume of the first exhaust chamber;

wherein exhaust gases from the engine flow to the first exhaust chamber, from the first exhaust chamber to the second exhaust chamber, from the second exhaust chamber to the third exhaust chamber, and from the third exhaust chamber to the exterior of the marine outboard engine.

10. The marine outboard engine of claim 9, further comprising:

at least one first conduit fluidly communicating the first exhaust chamber with the second exhaust chamber;

at least one second conduit fluidly communicating the second exhaust chamber with the third exhaust chamber; and at least one third conduit fluidly communicating the third exhaust chamber with the exterior of the marine outboard engine.

11. The marine outboard engine of claim 10, wherein an outlet of the at least one third conduit fluidly communicating with the exterior of the marine outboard engine is located vertically higher than the bladed rotor.

12. The marine outboard engine of claim 10, further comprising:

a first generally horizontal wall separating the second exhaust chamber from the third exhaust chamber; and a second generally horizontal wall disposed at a bottom of the third exhaust chamber;

wherein the at least one first exhaust conduit passes through an aperture in a generally vertical side of the first exhaust housing;

wherein the at least one second exhaust conduit passes through an aperture in the first generally horizontal wall; and wherein the at least one third exhaust conduit passes through an aperture in the second generally horizontal wall and an aperture in the lower cover.

13. The marine outboard engine of claim 9, wherein the first exhaust housing includes:

an upper end;

a lower end;

a first side wall extending generally vertically from the lower end to the upper end;

a second side wall, opposite the first side wall, extending generally vertically from the lower end to the upper end;

a first aperture in the first side wall near the upper end; and a second aperture in the second side wall near the upper end;

the marine outboard engine further comprising a conduit having a first end, a second end opposite the first end, a conduit body disposed between the first and second ends, and a plurality of apertures in the conduit body;

wherein the first end of the conduit is connected to the first aperture, the second end of the conduit is connected to the second aperture, the conduit body extending in the second exhaust chamber; and wherein exhaust gases from the first exhaust chamber flow in the first and second ends of the conduit, flow through the conduit body, and flow from the conduit body to the second exhaust chamber via the plurality of apertures in the conduit body.

14. The marine outboard engine of claim 9, wherein the first exhaust housing includes:

an upper end;

a lower end;

a wall disposed generally vertically inside the first exhaust housing, the wall dividing the first exhaust chamber so as to form a first sub-chamber and a second sub-chamber;

a first aperture between the upper and lower ends of the first exhaust housing, the first aperture fluidly communicating the first sub-chamber with the second sub-chamber; and a second aperture near the upper end of the first exhaust housing, the second aperture fluidly communicating the second sub-chamber with the second exhaust chamber;

wherein exhaust gases from the engine flow to the first sub-chamber, flow downwardly in the first sub-chamber to the first aperture, flow through the first aperture to the second sub-chamber, flow upwardly in the second sub-chamber, and flow through the second aperture to the second exhaust chamber.

15. The marine outboard engine of claim 14, wherein the wall disposed inside the first exhaust housing extends laterally inside the first exhaust housing.

16. The marine outboard engine of claim 15, wherein the first sub-chamber is disposed rearwardly of the second sub-chamber.

* * * * *